US006371841B1

(12) United States Patent
Ray

(10) Patent No.: US 6,371,841 B1
(45) Date of Patent: Apr. 16, 2002

(54) KNIFE MAINTENANCE APPARATUS HAVING TWO DISTINCT MAINTENANCE SURFACES

(76) Inventor: Ralph Ray, 37341 Hwy. 94, Box 1177, Boulevard, CA (US) 91905

( * ) Notice: Subject to any disclaimer, the term of this patent is extended or adjusted under 35 U.S.C. 154(b) by 0 days.

(21) Appl. No.: 09/532,678

(22) Filed: Mar. 21, 2000

Related U.S. Application Data

(63) Continuation-in-part of application No. 09/255,476, filed on Feb. 23, 1999, now Pat. No. 6,048,262.

(51) Int. Cl.[7] ..... B24D 15/00

(52) U.S. Cl. ..... 451/523; 451/524; 451/552; 451/556

(58) Field of Search ..... 451/523, 524, 451/552, 555, 556, 557, 558

(56) References Cited

U.S. PATENT DOCUMENTS 678,301 A 7/1901 Lucas
1,158,048 A 10/1915 Hawks
1,352,888 A 9/1920 Gallagher
2,380,539 A 7/1945 Miller
2,837,879 A * 6/1958 Lee
4,094,106 A 6/1978 Harris
4,197,677 A 4/1980 Graves
4,450,653 A * 5/1984 Fletcher
4,799,335 A * 1/1989 Battocchi
5,458,534 A * 10/1995 Campione et al.

* cited by examiner

*Primary Examiner*—Joseph J. Hail, III
*Assistant Examiner*—Willie Berry, Jr.
(74) *Attorney, Agent, or Firm*—Leonard Tachner

(57) ABSTRACT

An apparatus for maintaining culinary knifes, the apparatus having a handle assembly formed of a handle portion and a knife guide. An elongated tubular burnishing member is connected to the bottom end of the knife guide portion. A rubber friction tip is inserted into the bottom end of the tubular burnishing member. An elongated honing member is also coupled to the bottom end of the handle assembly and mounted in the interior of the tubular burnishing member. The burnishing member therefore performs a second function, that of being a protective sheath for the honing member.

24 Claims, 16 Drawing Sheets

KNIFE MAINTENANCE APPARATUS HAVING TWO DISTINCT MAINTENANCE SURFACES

RELATION TO CORRESPONDING APPLICATIONS

This patent application is a continuation-in-part of U.S. patent application Ser. No. 09/255,476 filed Feb. 23, 1999 and now issued U.S. Pat. No. 6,048,262.

BACKGROUND OF THE INVENTION

1. Field of the Invention

The invention relates to a combination device having both burnishing and honing elements and more specifically to a hand held "steel" device having a knife guide structure which establishes the required angle at which the blade of a culinary knife is to be burnished and/or honed.

2. Background Art

The conventional "steel" came to the United States in the 19th century. The manufacturer was I. Wilson Company from Sheffield, England. The F. Dick Company began exporting "steels" to the United States from Germany about a century ago and is the most respected maker today.

An example of a conventional "steel", such as existed for more than one hundred years is illustrated in the Lucas U.S. Pat. No. 678,301 that issued in 1901. Only minor improvements were made to the "steel" in the next twenty years. The Hawks U.S. Pat. No. 1,158,048 issued in 1915 and taught the use of a threaded rod to attach the handle to the "steel". In 1920 a U.S. Pat. No. 1,352,888 issued to Gallagher for a "steel" having abrasive material bonded in longitudinally extending grooves on the outer surface of the hone. Almost twenty-five years later the Miller U.S. Pat. No. 2,380,539 issued in 1945 showing a different "steel" structure with abrasive material bonded in grooves of an elongated member having a cross section like a plus (+) sign. None of these attempts to improve the basic chef's "steel" have changed the configuration of the traditional tool which is more than 100 years old.

In order to keep a chef's premium knife in slicing and carving condition, the edge of its blade should be burnished (rubbed and straightened) with a few strokes on a chef's "steel" before each use and several times during extended use. The proper technique of using the traditional "steel" is difficult and requires practice. It is difficult to orient the burnishing and/or honing device at the correct angle to the centerline of the knife while drawing the cutting edge across and down the length of the "steel". 22.5 degrees is the approximate half angle of the bottom edge or cutting edge of the knife blade. Culinary knives periodically require professional sharpening and reshaping by grinding to restore the cutting edge to the condition as manufactured. Home kitchen knives may require professional sharpening every one to five years. Restaurant knives require professional sharpening monthly. The convention for user maintenance of the cutting edge between professional sharpening is burnishing with a "steel". The chef's "steel" is a device with an elongated narrow rod of steel and a concentric handle at the top end with a symbolic guard between the handle and the burnishing rod to provide some protection so that users do not accidentally cut themselves with the knife during the "steeling" process. The guard is small (probably for storage reasons) and does not overcome the fear in a person drawing an intimidating kitchen knife towards one's wrist.

The chef's "steel" has been used primarily with the cutting edge moving towards the user's hand.

The inventor's novel "steel" is designed to be used with the cutting edge moving away from the user's hand which holds the "steel".

A quality culinary knife has a very fine cutting edge which curls. It curls when you cut with it and it curls when moisture is introduced. It curls at random on the left or the right side of the blade. The chef's "steel" is used to restore the straightness of the cutting edge by rubbing or burnishing at the same or slightly greater angle as the cutting edge. Five to seven strokes on each side was commonly recommended to straighten the edge due to the user's inability to align the cutting edge at the proper angle to the "steel".

To burnish high carbon steel knives with this "chef's steel", one of the cutting edges of the knife is drawn over one edge of the "chef's steel" at approximately a 22.5 degree angle on one side and then the other edge of the blade is drawn over the other side of the "chefs steel" at approximately a 22.5 degree angle. No means other than that which the operator conceives to be a 22.5 degree angle was provided. Therefore, the effectiveness of the burnishing and straightening process was inconsistent. A chef would not allow an apprentice to sharpen his knives because it would affect the efficiency of the knives if "steeled" at an angle other than the correct 22.5 degree angle.

To overcome the deficiencies in the prior art, sharpeners such as that of the Graves U.S. Pat. No. 4,197,677 were designed in 1976 with guide-guards attached to the opposite ends of an elongated cylindrical sharpening rod made of material. A handle extends outwardly from one of the guide-guards. This blade sharpener has been designed to be used in a horizontal manner.

Another "chefs steel" is disclosed in the Harris U.S. Pat. No. 4,094,106. This honing device was designed in 1976 to be used in a vertical position and it has a conical blade guide adjacent the top end of the "steel" to establish an appropriate angle at which to hold the knife blade for sharpening. The palm of the hand holding the honing device is oriented in the manner of a handshake.

The prior art sharpening "steels" still have problems that annoy their users. The horizontal sharpener of Graves has not been well received. The "chef's steel" when used in a vertical position requires the use of a handshake grip which obstructs vision and crowds the heel of the hand when burnishing wider blades. The bottom end of the "steel" has a tendency to slip or shoot outwardly at times during use. The great majority of the prior art chef's "steels" which reach the marketplace are quite heavy because they are made of solid steel. No meaningful improvements in the "chef's steel" have been made in the last twenty plus years.

OBJECTS OF THE INVENTION

It is an object of the invention to provide a novel combination culinary knife maintenance and sharpening "steel" that has both burnishing and honing structures in the same tool.

It is also an object of the invention to provide a novel "steel" that has a handle assembly that encourages its user to cup the palm of his hand over the top of this handle and which discourages the conventional handshake grip.

It is another object of the invention to utilize a burnishing stroke which has the cutting edge of the knife moving away from the user's hand. The conventional method has the cutting edge moving toward the user's hand.

It is a further object of the invention to provide a novel "steel" that has the burnishing element made of aluminum tubing that is hard anodized.

It is also an object of the invention to provide a novel "steel" that has structure on the bottom end that prevents it from slipping or shooting outwardly during its use.

It is an object of the invention to provide a novel "steel" whose weight is approximately half that of the prior art sharpening "steels".

It is another object of the invention to provide a novel "steel" made of several parts that are easily assembled.

It is an additional object of the invention to provide a novel "steel" that has an outer surface that is sufficiently hard to burnish or rub and straighten high carbon stainless steel knife blades.

SUMMARY OF THE INVENTION

The novel "steel" for culinary knives is extremely lightweight due to the use in a preferred embodiment of tubular stock such as aluminum whose outer surface has been hard anodized. The surface has a hardness equal to Rockwell C Scale 60 to 70. It is best measured by the Taber Abrasion Test per MIL-A-8625 F (or later) type Ill. The process for anodizing the tubular aluminum member results in a cross section showing that the anodizing process penetrates half its thickness into the aluminum and also grows outwardly an equal amount. The wall thickness of the tubular member would be in the range of 0.010–0.125 inches.

The Culinary Institute of America teaches several methods of "steeling" culinary knives. All methods show a "handshake" grip for the hand holding the "steel" and suggest five strokes on each side of the cutting edge. The novel "steel" requires only two strokes on each side of the cutting edge because each stroke is accurate.

Some features of the inventor's maintenance and sharpening "steel" that significantly assist the person using it include the novel handle assembly which allows the user to utilize a palm grip which positions the wrist and hand out of the way so that the user can see the process unimpeded. It is a natural grip and the user can relax. Holding the "steel" securely does not require any force other than the weight of the user's hand. The sharp cutting edge of the knife is moving away from the user's hand. These features contribute to both perceived and actual safety and ease of use. This results in greater compliance with knife maintenance quality and frequency.

The angle guide starts the burnishing or honing process at the correct angle to the burnishing or honing surface.

The friction tip on the bottom end of the novel "steel" prevents it from slipping or sliding outwardly during use. The use of a hollow burnishing member made of aluminum, or other selected materials, significantly reduces the weight of this member. Some examples of other tubular burnishing members would be 1) hardened steel tube, 2) surface hardened steel tube, 3) nickel coated steel tube with supplemental treatment for hardness, 4) titanium tube with hard anodized coating, 5) chromium coated tube; and 6) titanium nitride tube. The cross section of the tube may be various shapes such as round, oval, or a polygon.

The surface of hard anodized aluminum is harder than steel. With the novel burnishing device, two strokes on each side will correct the straightness of the cutting edge of the knife due to the fact that if the user orients the knife blade at the proper angle to the "steel" by placing the blade on the angle guide at the beginning of each stoke, each stroke will be accurate and effective.

An alternative embodiment of the novel "steel" provides a structure for honing the cutting edge of a culinary knife. The burnishing structure is the tubular member connected to the bottom end of the handle structure. More specifically, the hard outer surface is used primarily for straightening the cutting edge of the culinary knife. It straightens a curled cutting edge, microscopic curves, bends, bumps, etc. caused by normal use and also exposure to water and moisture. It is not the purpose of the burnishing surface to sharpen (i.e., remove material from the cutting edge of the knife). The structure for honing or sharpening the cutting edge of a culinary knife is an elongated hard abrasive member that may be in the form of a rod or a tube. The burnishing member has its top end removably secured to the bottom end of the handle structure. The burnishing member has the dual function of burnishing and providing a housing or sheath for the honing member. The honing member is hard and may be brittle so it is appropriate to protect it. The honing member may be permanently attached to the handle structure. The handle structure for the alternative embodiment comes in various forms. The cross section of the honing member may be various shapes such as round, oval, or a polygon.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF THE PREFERRED EMBODIMENT

Figure 1A:
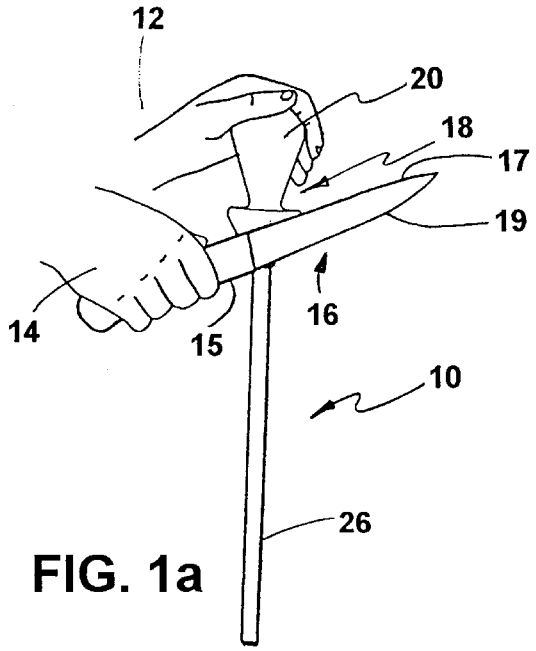
FIGS. 1*a* through 1*c* are front perspective views illustrating the manner in which the novel "steel" is used.
Figure 1B:
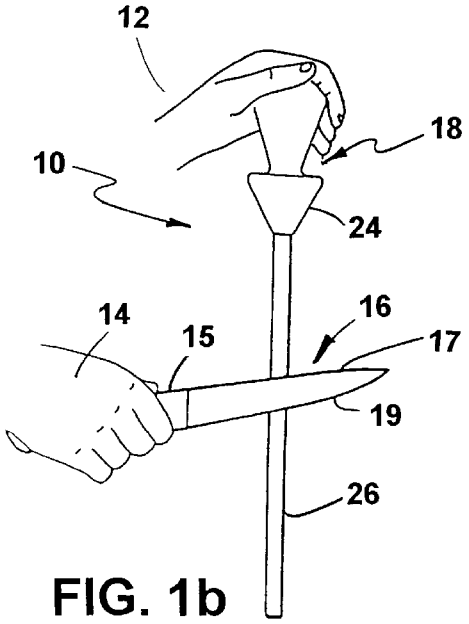
Figure 1C:
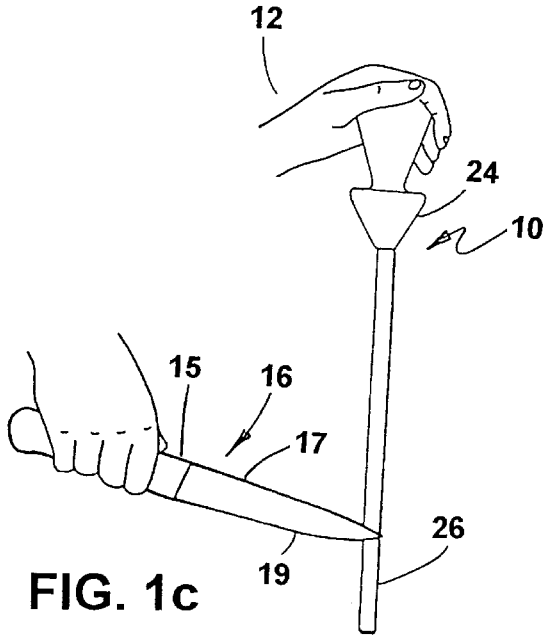
Figure 2:
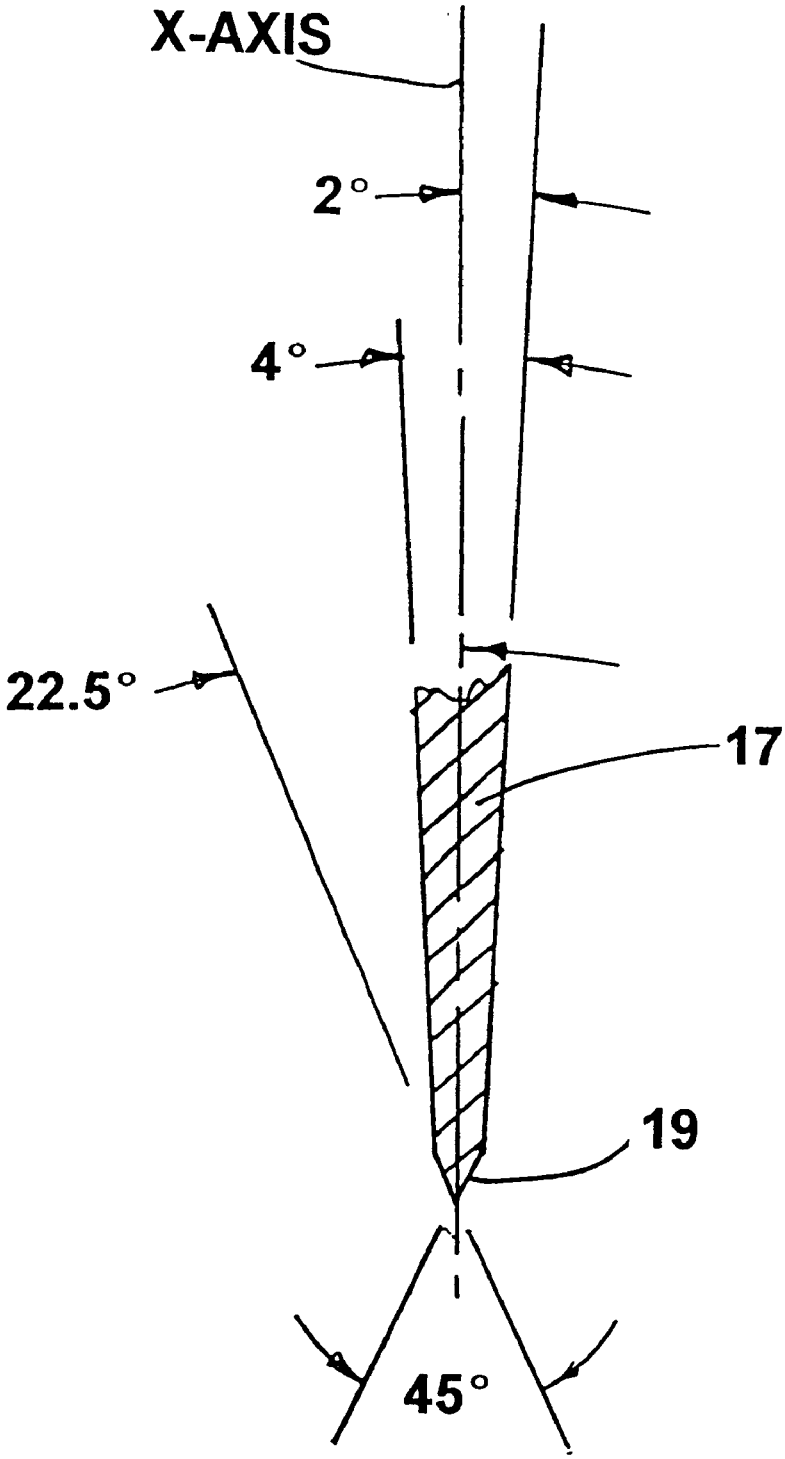
FIG. 2 is an enlarged partial vertical cross sectional view of the bottom edge of a high carbon steel culinary knife.

The novel "steel" for culinary knives will now be described by referring to FIGS. 1–5 of the drawings. The "steel" is generally designated numeral 10.

A person using the "steel" places a hand 12 with the palm resting on the top of knob portion 20 of handle assembly 18. The bottom end of burnishing device 10 is rested on a horizontal surface (not shown). The person's other hand 14 holds handle 15 of knife 16. Knife 16 has a blade 17 having a bottom cutting edge or tip 19. Blade 17 is normally made of high carbon stainless steel. The bottom cutting edge or tip 19 has an all inclusive angle of approximately 45 degrees, with 22.5 degrees on each side of its vertical X-axis (see FIG. 2).

In the preferred embodiment, tubular burnishing member 26 is made of aluminum having a hard anodized outer surface which Rockwell C Scale hardness is in the 60 to 70 range. Tubular burnishing member 26 has a diameter W1 in the range of 0.375–1.25 inches. Tubular burnishing member 26 has a height H3 in the range of 7–13 inches. It has a wall thickness T1 in the range of 0.010–0.125 inches. The wall thickness is in the range of 2%–10% of the diameter of tubular burnishing member 26 (see FIG. 2 and FIG. 3).

Figure 4:
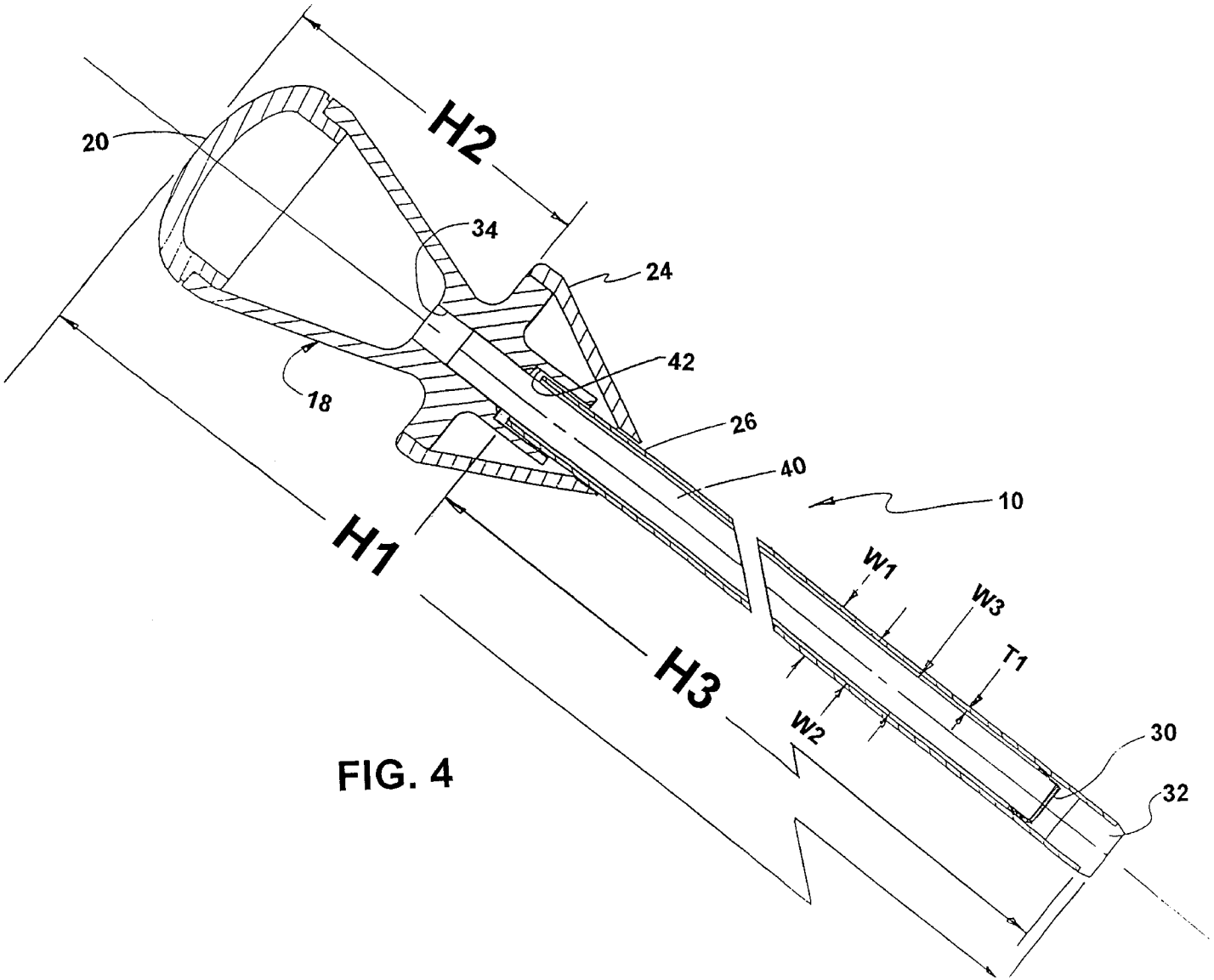
FIG. 4 is a longitudinal cross section of the "steel" illustrated in FIG. 3.
Figure 5:
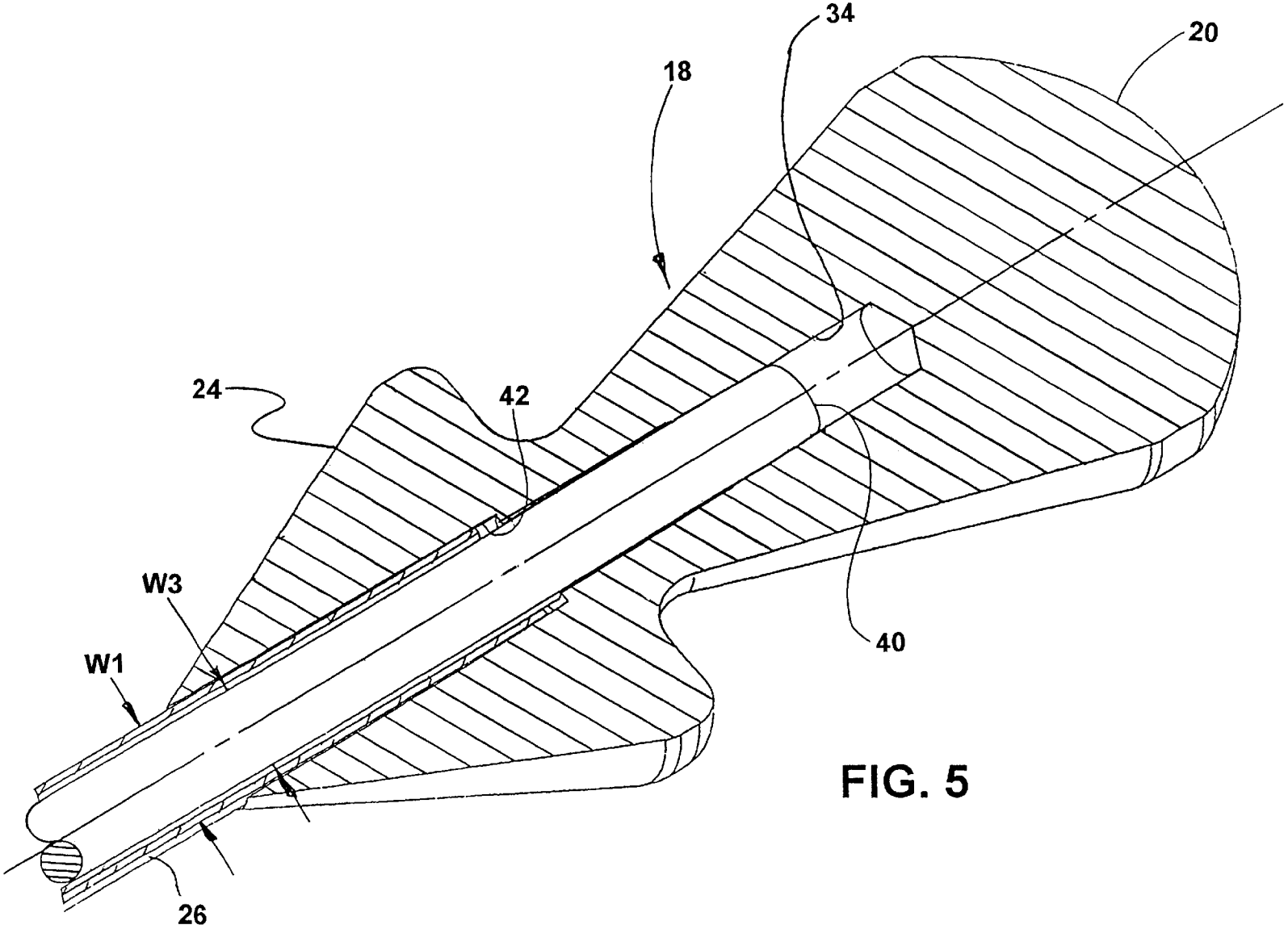
FIG. 5 is an enlarged cross sectional view of the combination handle and knife guide illustrated in FIG. 3.

The structure of the "steel" is best understood by referring to FIGS. 4 and 5. The "steel" is generally designated numeral 10. It has a combination handle and knife guide member 18 having a handle portion 20 and a knife guide portion 24. An elongated hole 34 extends into the bottom end of member 18 and it has a predetermined diameter that frictionally engages the honing member 40 which outer diameter is slightly larger. A counterbore hole 42 is formed adjacent the bottom end of knife guide portion 24 to form an annular recess for receiving tubular burnishing member 26. A resilient rubber friction tip 32 closes the bottom end of tubular burnishing member 26. The bottom end of honing member 40 has a resilient friction tip 30 in the form of a cap which fits on the end of the honing member 40.

Figure 6:
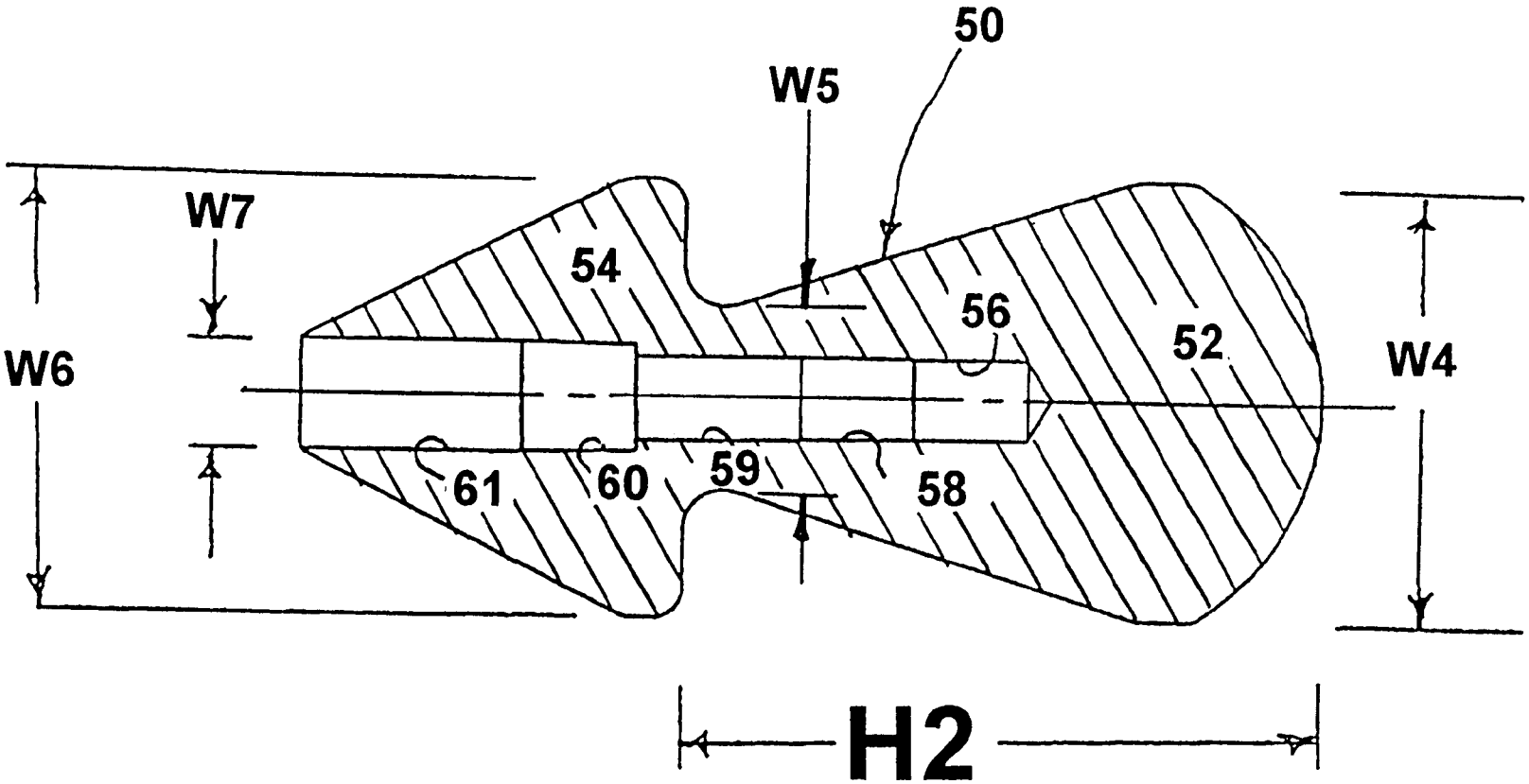
FIG. 6 is a longitudinal cross sectional view of the combination handle and knife guide member.

A first alternative embodiment of the combination handle and knife guide is illustrated in FIG. 6 and is generally designated number 50. It has a handle portion 52 and a knife guide portion 54. It has a hole 56 having various portions 58–61. Portion 59 has a diameter slightly larger than the diameter of honing member 40. Portion 58 has a tapered diameter that runs from the edge of portion 59 to hole 56. The largest diameter of portion 58 is slightly larger than that of the diameter of honing member 40. As honing member 40 is inserted through portion 59, it enters portion 58 and with axial force it will wedge itself into a rigid connection in portion 58. Portion 61 has a cylindrical inner diameter only slightly larger than the outer diameter of tubular burnishing member 26. Portion 60 has a tapered diameter that grows smaller as it travels from portion 61 toward portion 59. Tubular burnishing member 26 is inserted into portion 61 rather smoothly and upon reaching portion 60 is given a twisting motion and further axial motion which will adequately retain it in portion 60. Tubular burnishing member 26 is held sufficiently tightly so that when the "steel" is being used to burnish the cutting edge of a culinary knife, the tubular burnishing member will be held so as not to be dislocated. Additionally, the "steel" is used in a vertical manner thus having its resilient tip 32 pressed against the support surface which holds the assembly together. Handle portion 20 has a height H2 in the range of 3–6 inches and a width W4 in the range of 1.5–3.5 inches at its top end and width W5 in the range of 0.5–1.5 inches at its bottom end. Knife guide portion 54 has a width W6 in the range of 0.5–3.0 inches at its top end and a width W7 in the range of 0.2–1.3 inches at its bottom end.

Figure 7:
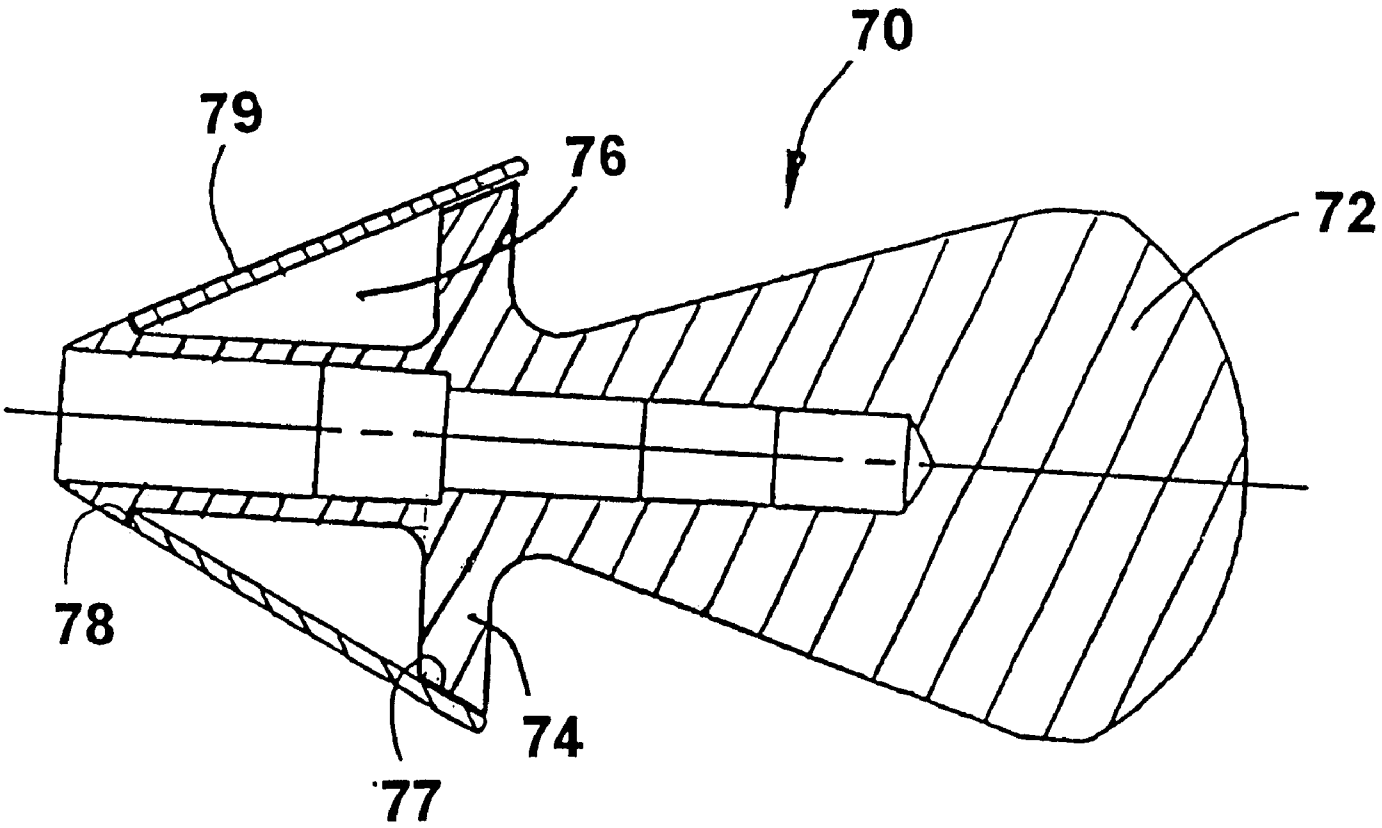
FIG. 7 is a longitudinal cross section view of a first alternative embodiment of the combination handle and knife guide member.

A second alternative embodiment of the combination handle and knife guide member is illustrated in FIG. 7. It is generally designated number 70 and it has a handle portion 72 and an knife guide portion 74. It has the same structure as that illustrated in FIG. 6 for receiving the honing member 40 and the tubular burnishing member 26. An annular cavity 76 is formed when member 70 is molded and it would have an annular centering shoulder 77 and an annular locking shoulder 78. A conical piece of sheet metal, such as stainless steel material 79 can be snapped into place between the two respective locking shoulders 77 and 78 by squeezing the bottom end of the knife guide portion 74 into a smaller diameter than the bottom diameter of the conical piece 79. Conical piece 79 could also be glued or welded in place.

Figure 8:
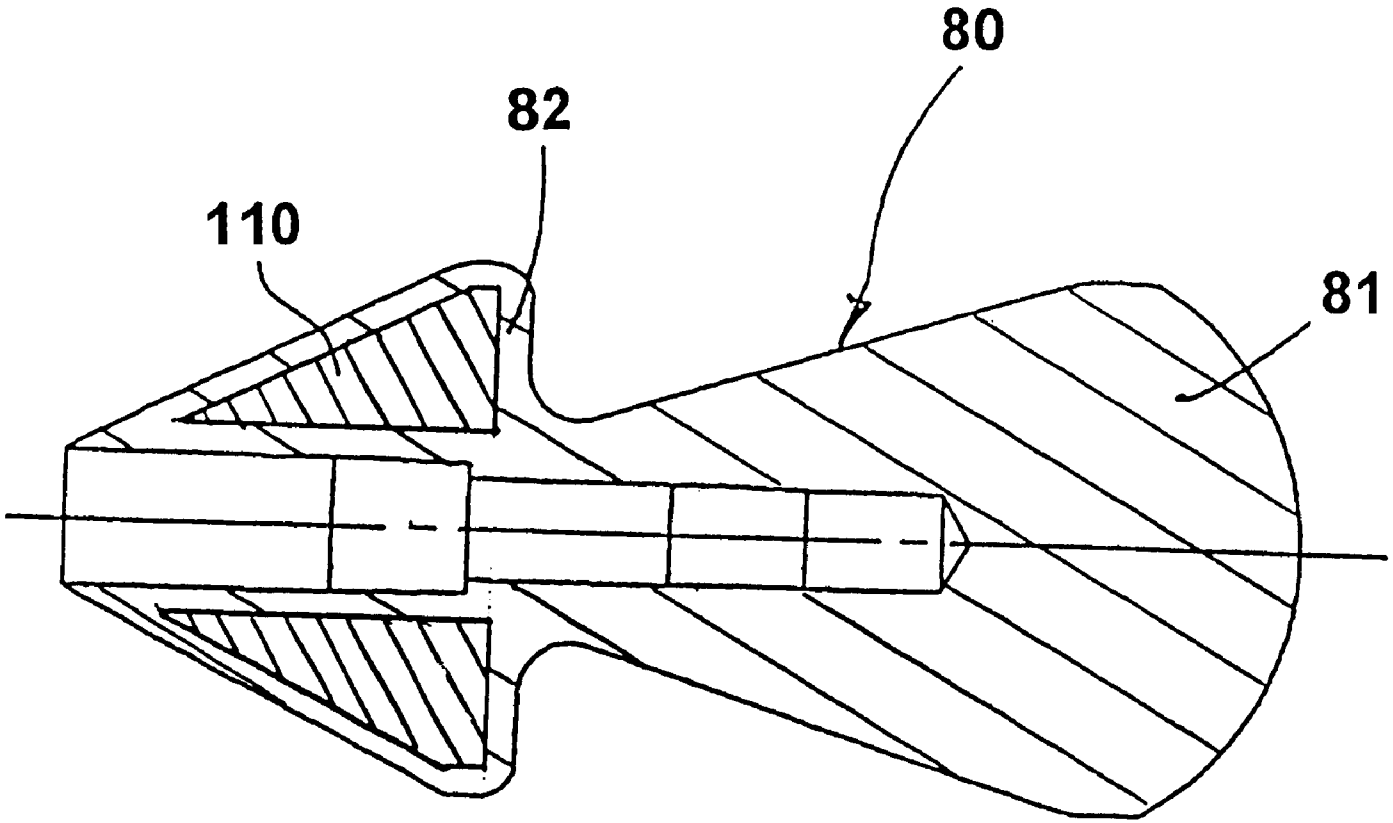
FIG. 8 is a longitudinal cross section view of a second alternative embodiment of the combination handle and knife guide member.

The third alternative embodiment of the combination handle and knife guide member is designated numeral 80 and is illustrated in FIG. 8. It has a handle portion 81 and a knife guide portion 82. It's hole structure is the same as that illustrate in FIG. 6. Before the molding operation a truncated bored conical insert 110 is placed in the mold for bulk fill to reduce shrinkage and/or control surface characteristics such as uniformity, color, design patter and smoothness.

Figure 9:
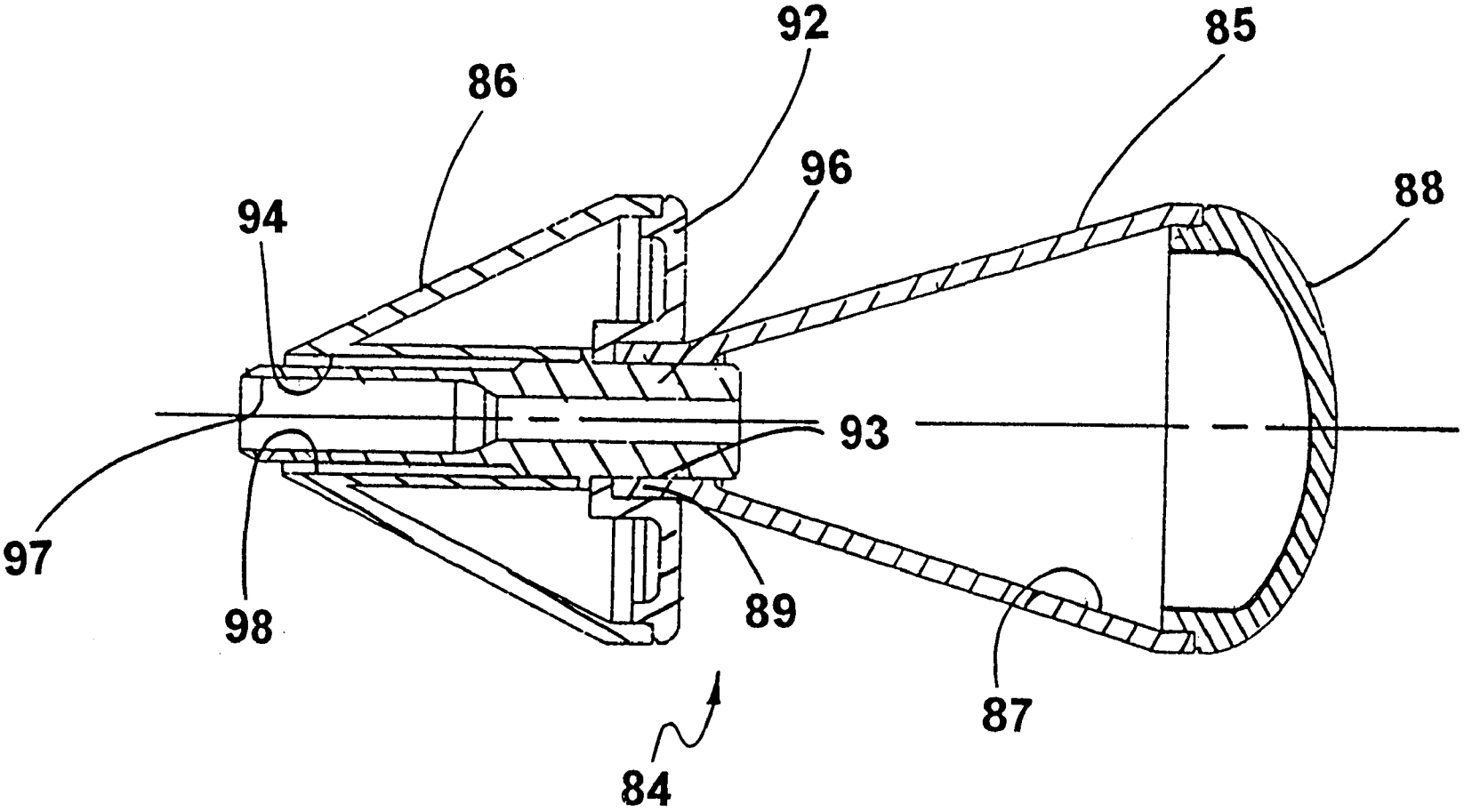
FIG. 9 is a longitudinal cross section view of a third alternative embodiment of the combination handle and knife guide structure.
Figure 10:
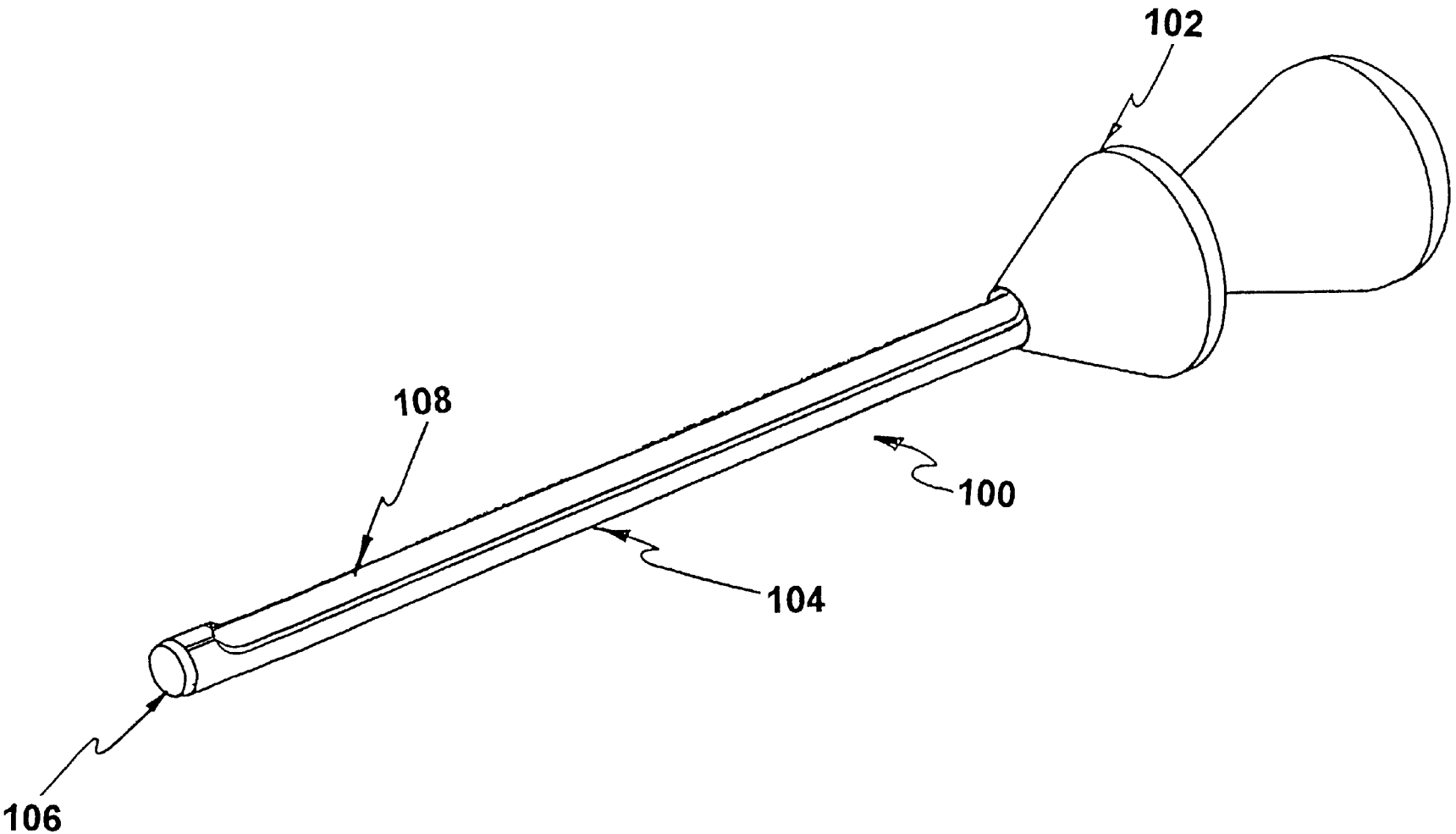
FIG. 10 is a front perspective view of a first alternative embodiment of the novel "steel"
Figure 11:
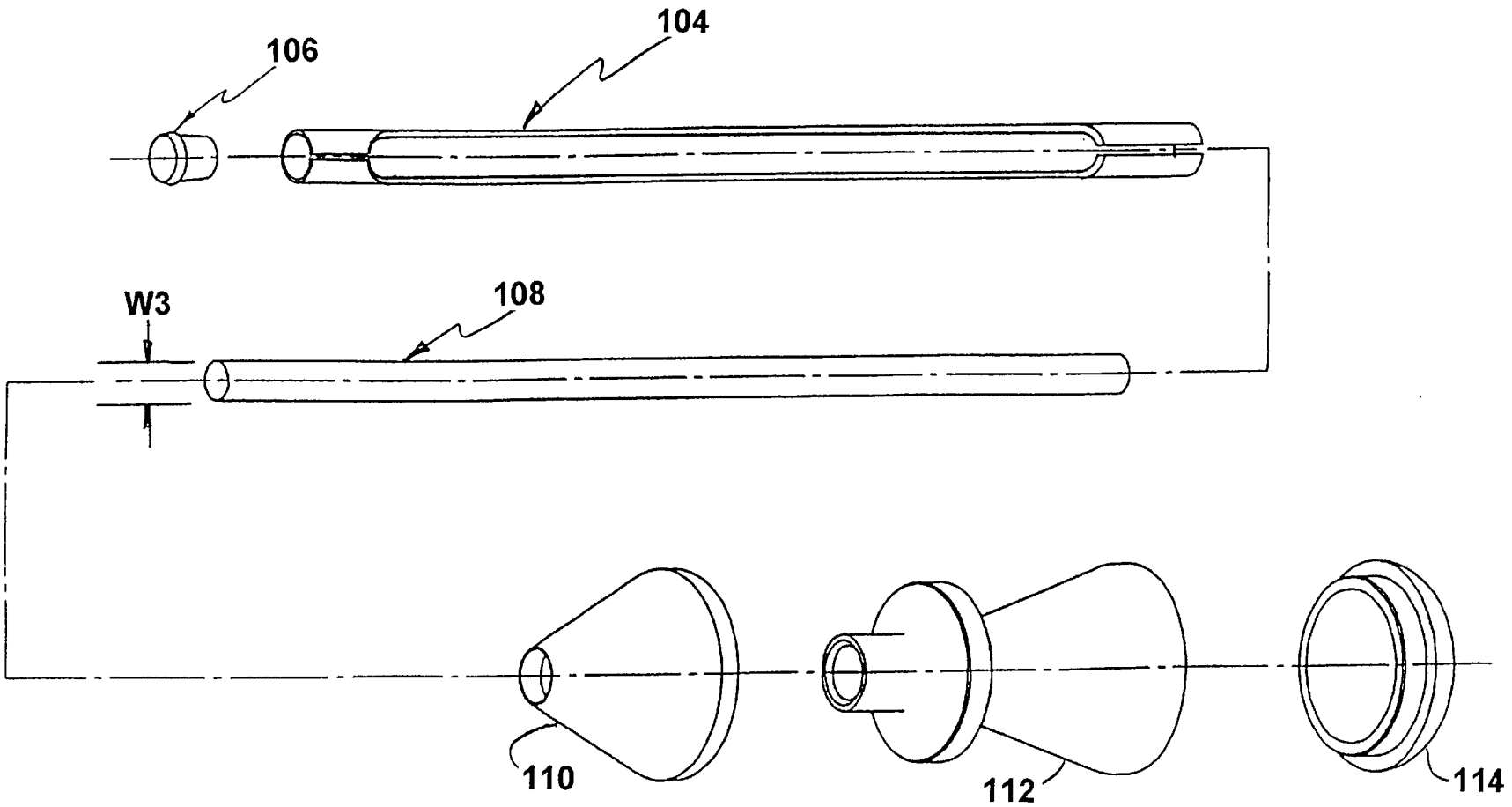
FIG. 11 is an exploded front perspective view of the first alternative embodiment of the novel "steel" illustrated in FIG. 10.
Figure 12:
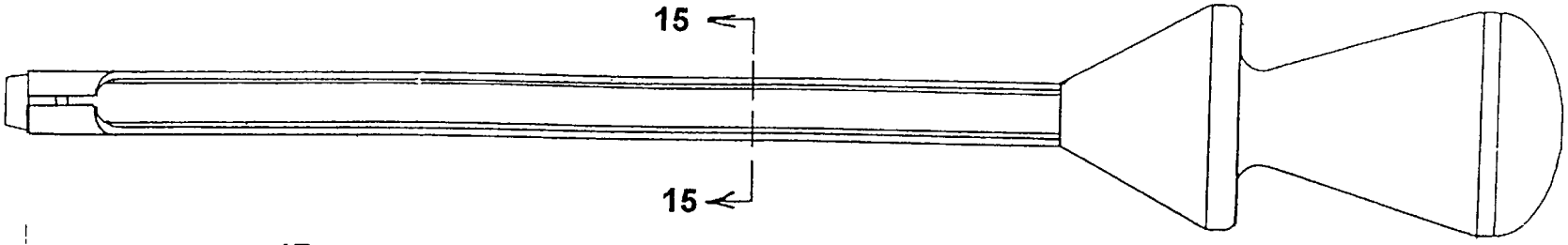
FIG. 12 is a top plan view of the first alternative embodiment of the novel "steel" illustrated in FIG. 10.
Figure 14:
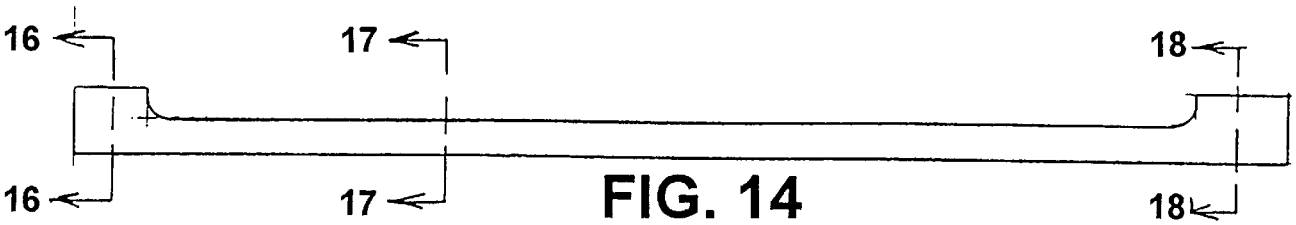
FIG. 14 is a side elevation view of the tubular member of the first alternative embodiment of the novel "steel"
Figure 13:
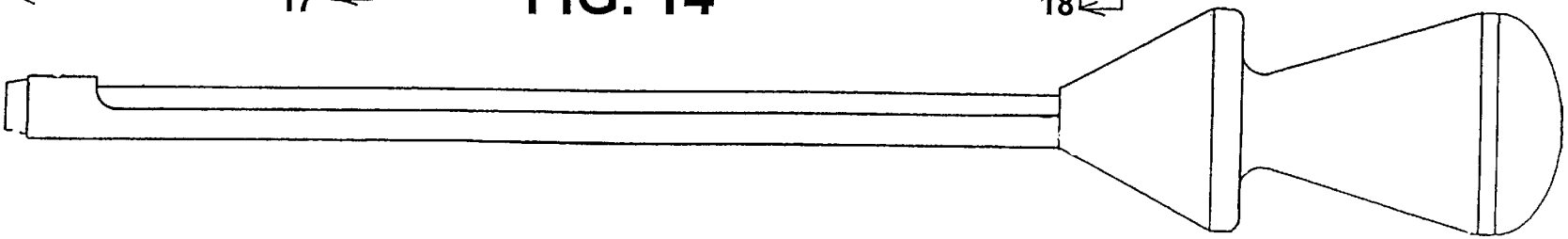
FIG. 13 is a side elevation view of the first alternative embodiment of the novel "steel" illustrated in FIG. 10.
Figure 18:
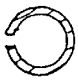
FIG. 18 is a cross section taken along lines 18—18 of FIG. 14.
Figure 15:
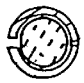
FIG. 15 is a cross section taken along lines 15—15 of FIG. 12.
Figure 17:
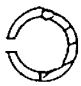
FIG. 17 is a cross section taken along lines 17—17 of FIG. 14.
Figure 16:
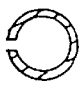
FIG. 16 is a cross section taken along lines 16—16 of FIG. 14.

A fourth alternative embodiment of the combination handle and knife guide is illustrated in FIG. 9. It is generally designated numeral 84 and it has a separately molded handle portion 85 and a separately molded knife guide portion 86. Handle portion 85 has been molded with a hollow interior cavity 87 that is closed by a hollow interior cover 88. The bottom end of handle portion 85 has a neck 89 that fits within a hole in cover 92. Neck 89 has a hole 93 whose purpose will be described later. Knife guide portion 86 has a hole 94 that receives a coupling 96 that is locked therein. Coupling 96 has a hole 97 that receives honing member 40. A recess 98 is formed between the outer surface of coupling 96 and hole 94 and it removably receives the top end of tubular burnishing member 26 in the manner previously described. The entire assembly may be bonded or welded together.

A first alternative embodiment of the novel "steel" is illustrated in FIGS. 10–18. The device is generally designated numeral 100. It has a combination handle and knife guide member 102, a tubular burnishing member 104 and a resilient friction tip 106. Tubular burnishing member 104 has about half of its outer surface cut away for the better part of its length to expose the honing/sharpening member 108. This allows "steel" to be used both as a burnishing tool and a sharpening tool without the necessity of removing the tubular burnishing member. The combination handle and knife guide member 102 is formed from the knife guide portion 110, the handle portion 112 and cover member 114.

The tubular burnishing element 104 may be fabricated by rolling or otherwise forming the tubular shape from sheet material resulting in a circumferential gap in the range of closed to open 70 percent of the circumference as illustrated in FIGS. 11, 12, and 16 through 18. This method produces a uniform wall thickness and a lower manufacturing cost than seamless tubing and a radial spring characteristic which enables the removable and rotatable feature.

Figure 3:
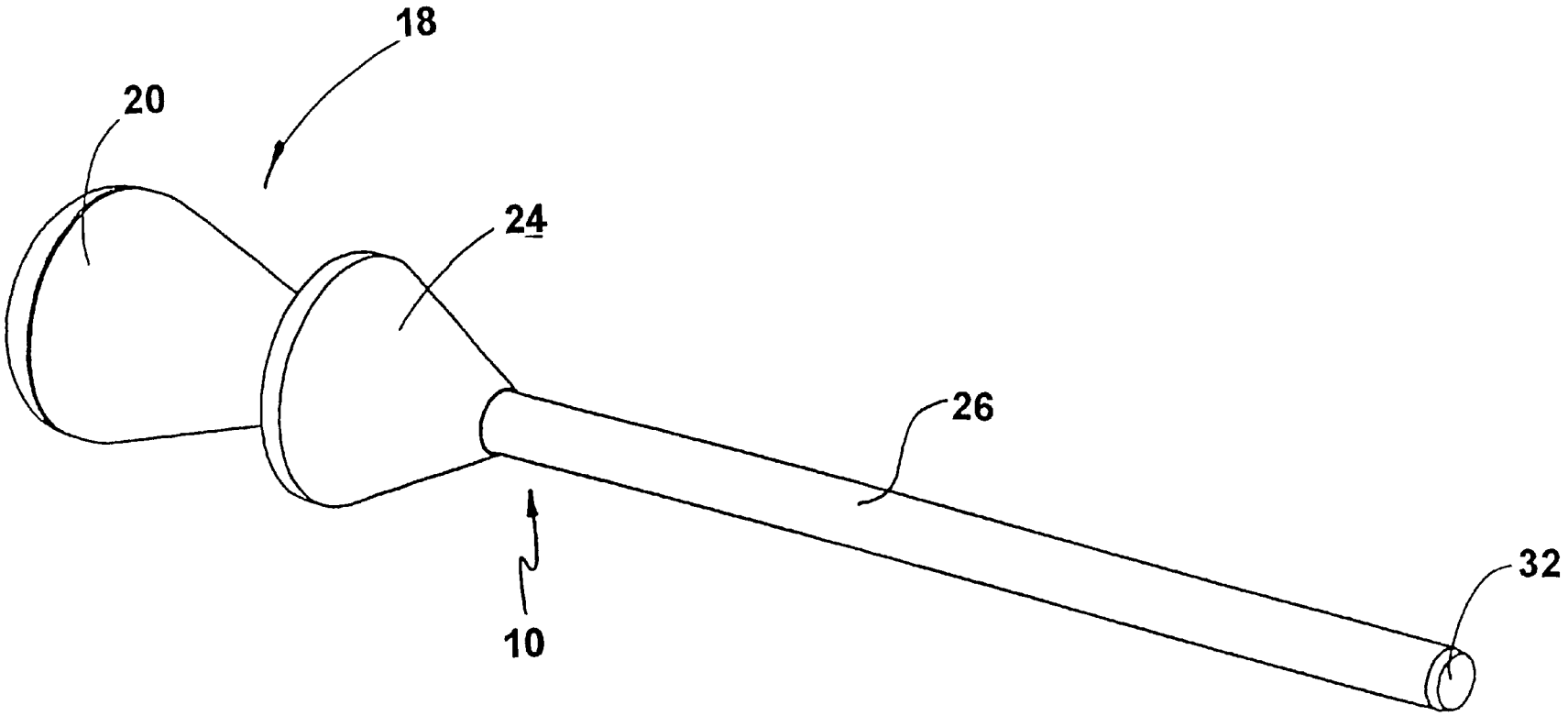
FIG. 3 is a front perspective view of the novel "steel"

The tubular burnishing element can be made from seamed, seamless or welded tubing as seen in FIGS. 3 through 5.

Figure 19:
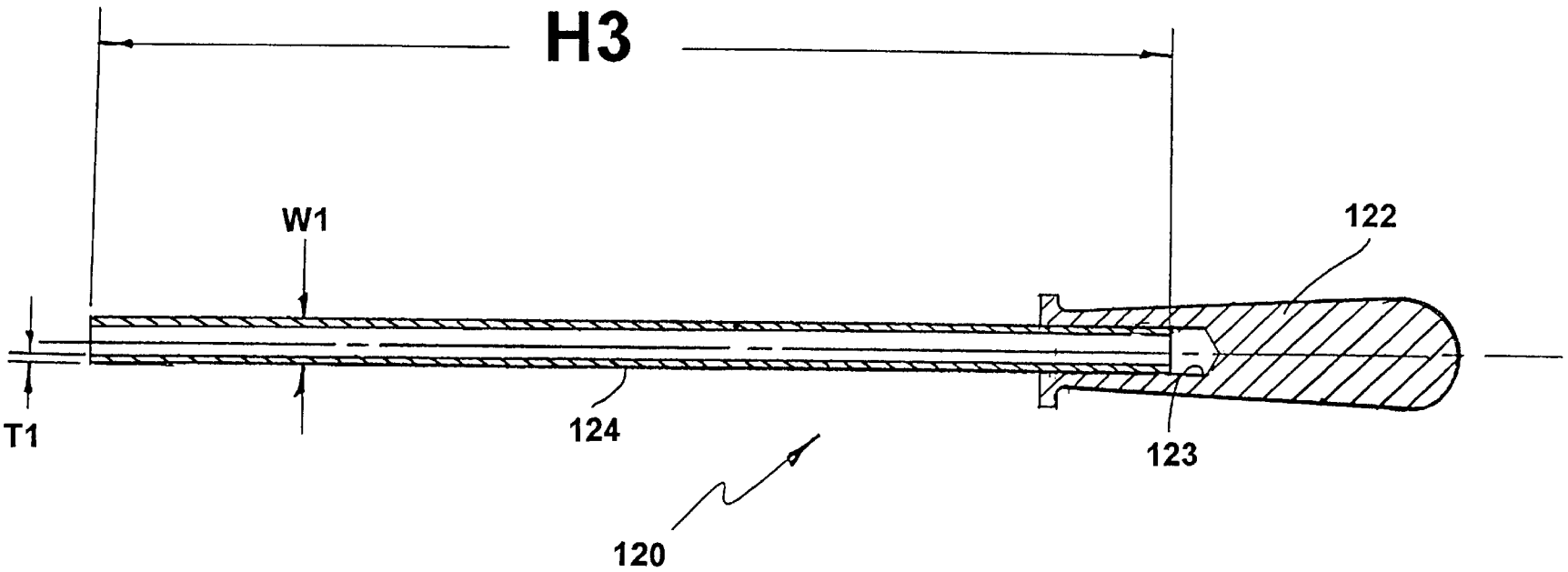
FIG. 19 is a longitudinal cross sectional view of a second alternative embodiment of the novel "steel"
Figures 20, 21:
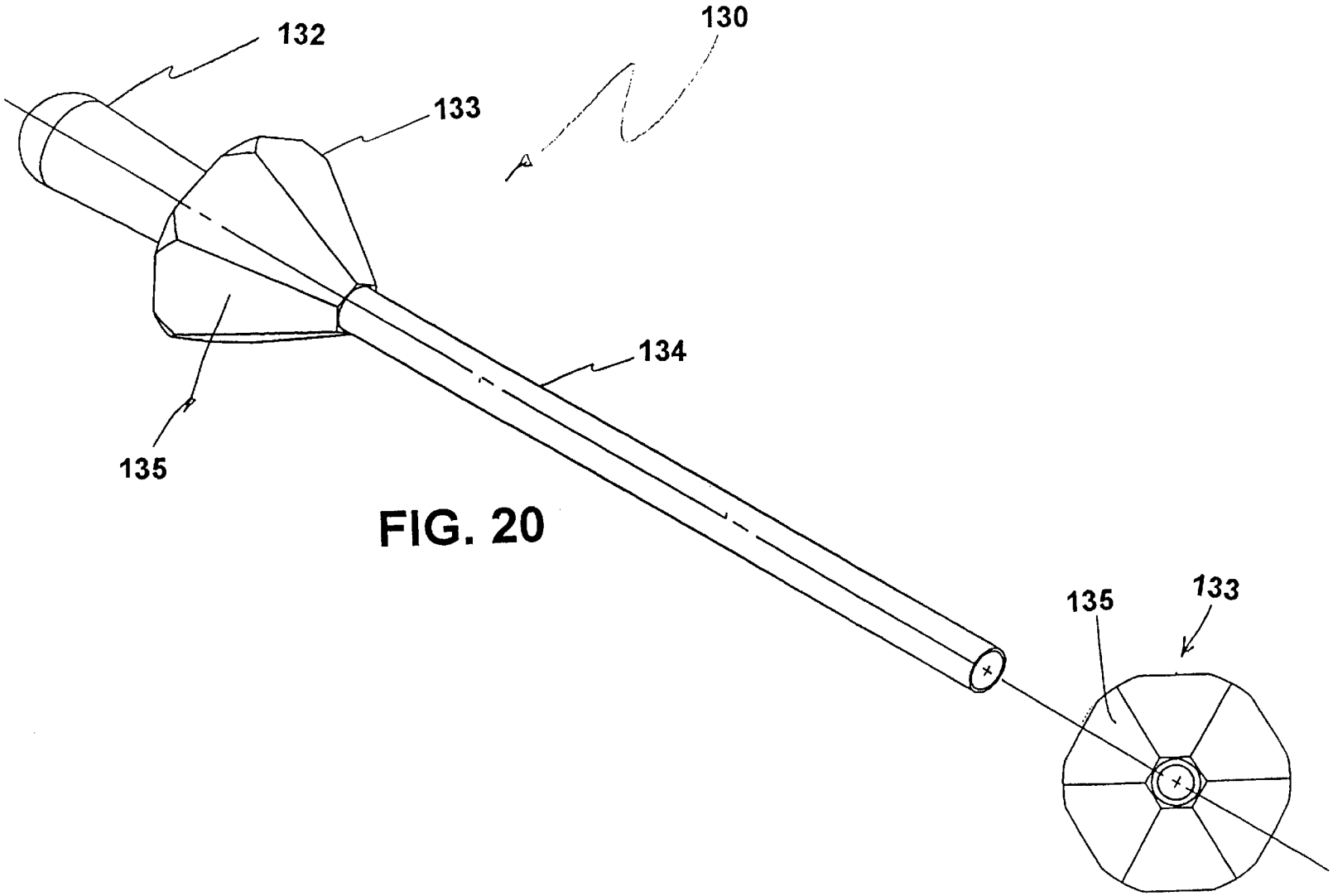
FIGS. 20 through 27 provide various views of alternative knife guide configurations.

A second alternative embodiment of the novel "steel" is illustrated in FIG. 19. The device is generally designated numeral 120. It has a handle 122 having a hole 123 in its bottom end. The tubular burnishing member 124 is made of the same material as that of the previous embodiments. It also functions in a like manner.

Figure 23:
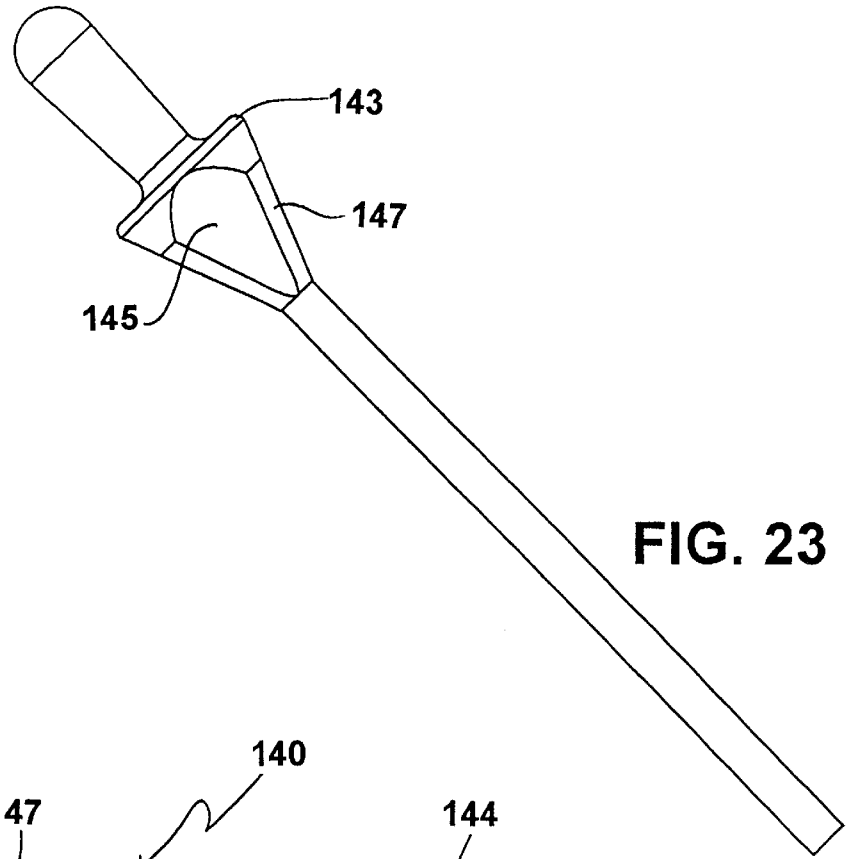
Figure 24:
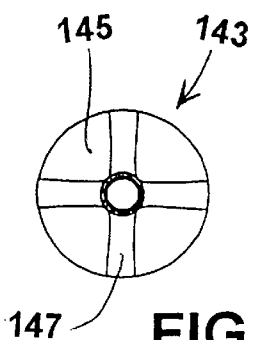
Figure 22:
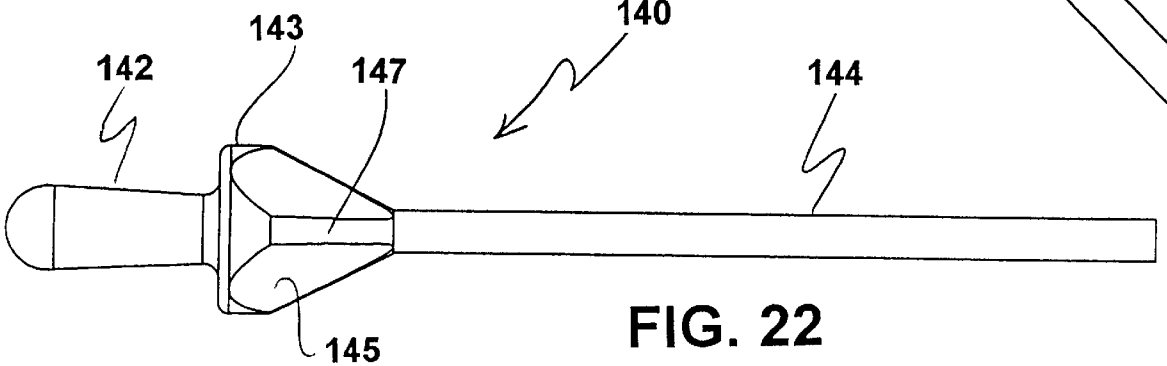
Figure 26:
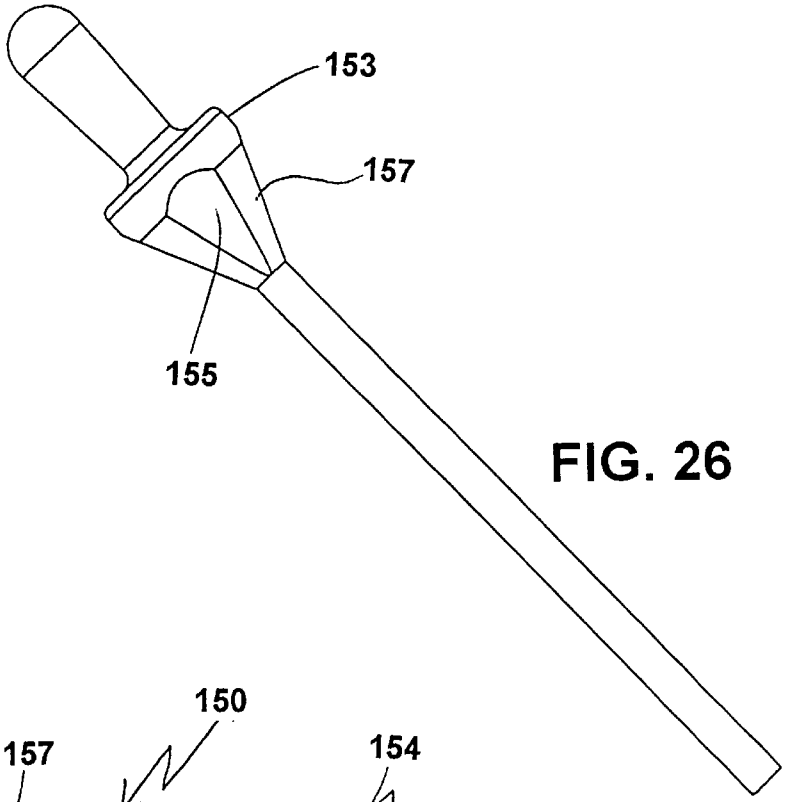
Figure 25:
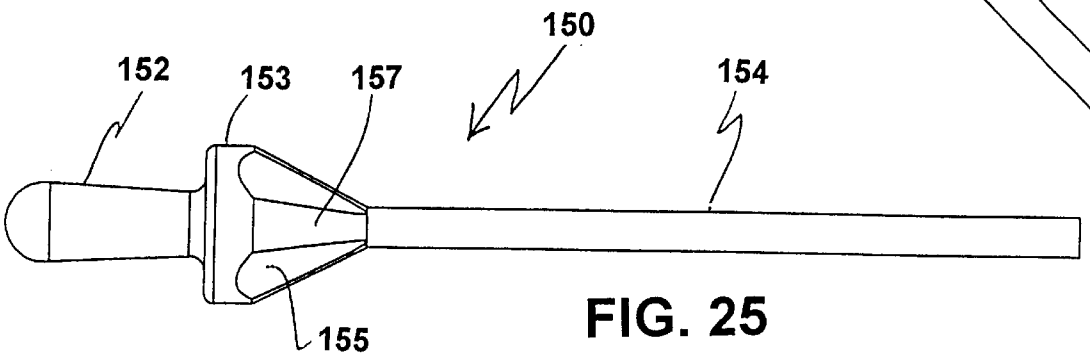
Figure 27:
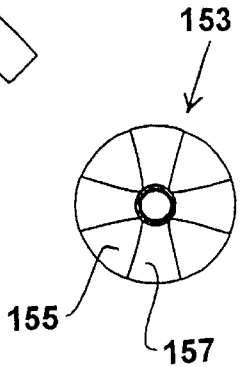

FIGS. 20 through 27 illustrate three different alternative embodiments of a knife guide. One such embodiment shown in FIGS. 20 and 21. Specifically, in a knife maintenance device 130 comprising a burnishing surface 134 and a handle structure 132, a knife guide 133 has a plurality of planar guide surfaces 135. Planar guide surfaces provide a more stable guide than a conical guide surface because the knife blade is initially supported by a surface and not just a line of intersection. In the knife guide embodiments of FIGS. 22 through 24 and FIGS. 25 through 27, respective devices 140 and 150, have burnishing surfaces 144 and 154 and handle structures 142 and 152, respectively. Respective guides 143 and 153, provide two different guide surfaces. Specifically, guide 143 of FIGS. 22 through 24, provides surfaces 145 at one selected guide angle and surfaces 147 at a different selected guide angle. Similarly, guide 153 of FIGS. 25 through 27, provides surfaces 155 at one selected guide angle and surfaces 157 at a different selected guide angle. It will be understood that many other multiple surface guide angle configurations are possible.

Having thus described a number of alternative embodiments of the invention, it being understood that many further embodiments are contemplated and will now occur to those having the benefit of the above disclosure, what I claim is:

1. A combined knife edge burnishing and honing apparatus comprising:

a pair of concentric elongated cylinders having accessible outer radial surfaces, the outer radial surface of one of said cylinders being a knife edge burnishing surface, the outer radial surface of the other of said cylinders being a knife edge honing surface.

2. The apparatus recited in claim 1 further comprising a handle structure to which said cylinders are attached as an inner cylinder and an outer tubular cylinder.

3. The apparatus recited in claim 2 wherein said handle structure comprises an integral guide portion for orienting a knife to a selected angle relative to said outer radial surfaces.

4. The apparatus recited in claim 3 wherein said guide portion is shaped as a conical frustum.

5. The apparatus recited in claim 3 wherein said guide portion comprises a plurality of contiguous planar surfaces, each said surface being inclined relative to said radial surfaces at a selected angle.

6. The apparatus recited in claim 5 wherein at least one of said inclined surfaces has a different selected angle than at least one other of said inclined surfaces.

7. The apparatus recited in claim 2 wherein said outer tubular cylinder comprises a burnishing surface and said inner cylinder comprises a honing surface.

8. The apparatus recited in claim 2 wherein a portion of said outer cylinder is omitted to provide access to at least a portion of the radial surface of said inner cylinder.

9. The apparatus recited in claim 1 wherein said cylinders are circular cylinders.

10. The apparatus recited in claim 1 wherein one of said cylinders is selectively removable to permit access to the other of said cylinders.

11. The apparatus recited in claim 1 wherein said burnishing surface is made of a hardened metal.

12. The apparatus recited in claim 11 where said metal is taken from the group consisting of aluminum, nickel, titanium and respective alloys thereof.

13. A combined knife edge burnishing and honing apparatus comprising:

a pair of concentric elongated cylinders having accessible outer radial surfaces, the outer radial surface of one of said cylinders being a knife edge burnishing surface, the outer radial surface of the other of said cylinders being a knife edge honing surface;

a handle structure to which said cylinders are attached as an inner cylinder and an outer tubular cylinder;

wherein said handle structure comprises an annular recess for releasibly receiving said outer tubular cylinder and a cylindrical channel for receiving said inner cylinder.

14. A knife edge maintenance apparatus comprising:

a pair of concentric elongated cylinders having accessible outer radial surfaces, one being made of a different material than the other said outer radial surface to provide at least two distinct forms of knife edge maintenance depending upon which of said outer radial surfaces is selected for application to a knife edge.

15. The apparatus recited in claim 14 wherein said distinct forms of knife edge maintenance comprises burnishing and honing.

16. The apparatus recited in claim 14 further comprising a handle structure to which said cylinders are attached as an inner cylinder and an outer tubular cylinder.

17. The apparatus recited in claim 16 wherein said handle structure comprises an integral guide portion for orienting a knife to a selected angle relative to said radial surfaces.

18. The apparatus recited in claim 17 wherein said guide portion is shaped as a conical frustum.

19. The apparatus recited in claim 17 wherein said guide portion comprises a plurality of contiguous planar surfaces, each said surface being inclined relative to said radial surfaces at a selected angle.

20. The apparatus recited in claim 19 wherein at least one of said inclined surfaces has a different selected angle than at least one other of said inclined surfaces.

21. The apparatus recited in claim 14 wherein said cylinders are circular cylinders.

22. The apparatus recited in claim 14 wherein one of said cylinders is selectively removable to permit access to the other of said cylinders.

23. The apparatus recited in claim 14 wherein a portion of said outer cylinder is omitted to provide access to at least a portion of the outer radial surface of said inner cylinder.

24. A knife edge maintenance apparatus comprising:

a pair of concentric elongated cylinders having accessible outer radial surfaces, one being made of a different material than the other said outer radial surface to provide at least two distinct forms of knife edge maintenance depending upon which of said outer radial surfaces is selected for application to a knife edge;

a handle structure to which said cylinders are attached as an inner cylinder and an outer tubular cylinder;

wherein said handle structure comprises an annular recess for releasibly receiving said outer tubular cylinder and a cylindrical channel for receiving said inner cylinder.

* * * * *